United States Patent [19]

Elmore et al.

[11] Patent Number: 4,638,855

[45] Date of Patent: Jan. 27, 1987

[54] HEAT EXCHANGE TREATMENT OF FLUIDS

[75] Inventors: Carl L. Elmore; Ted M. Poulin; Mark D. Barrett, all of Glens Falls, N.Y.

[73] Assignee: Kamyr, Inc., Karlstad, Sweden

[21] Appl. No.: 637,574

[22] Filed: Aug. 3, 1984

Related U.S. Application Data

[62] Division of Ser. No. 480,752, Mar. 31, 1983, Pat. No. 4,519,446.

[51] Int. Cl.[4] ..... F28F 27/02

[52] U.S. Cl. ..... 165/101; 165/115

[58] Field of Search ..... 165/100, 101, 115, 140, 165/110

[56] References Cited

U.S. PATENT DOCUMENTS

| | | | |
|---|---|---|---|
| 1,354,276 | 9/1920 | Bancel | 165/100 X |
| 3,351,119 | 11/1967 | Rosenblad | 165/115 X |
| 3,802,496 | 4/1974 | Ris et al. | 165/101 |
| 4,296,802 | 10/1981 | Larinoff | 165/110 |
| 4,319,630 | 3/1982 | Hronek et al. | 165/140 X |

FOREIGN PATENT DOCUMENTS

| | | | |
|---|---|---|---|
| 160264 | 12/1954 | Australia | 165/101 |
| 3024819 | 1/1982 | Fed. Rep. of Germany | 165/140 |
| 35397 | 3/1983 | Japan | 165/101 |

*Primary Examiner*—Albert W. Davis, Jr.

*Assistant Examiner*—Peggy A. Neils

*Attorney, Agent, or Firm*—Nixon & Vanderhye

[57] ABSTRACT

An assembly and method provide for the simultaneous heating of process inlet water from a clean water source, and condensing of a condensable gas using the process inlet water and a closed loop of condensing water. A plurality of pairs of condenser plates are disposed in an annular array in a vertical cylindrical vessel. First and second liquid inlets are disposed at the top of the vessel separated by a radially extending fixed baffle, and first and second liquid outlets are disposed at the bottom of the vessel separated by a radially extending fixed baffle. A condensable gas passes through the interiors of the pairs of condensing plates. Movable top and bottom baffles are rotatable through arcs to change the number of condensing plates operatively communicating the first liquid inlet with respect to the second liquid inlet, the liquid flowing between the first liquid inlet and outlet being always segregated from the liquid flowing between the second liquid inlet and outlet. The first inlet is connected up to a source of clean water, such as a river, and the movement of the baffles is adjusted in response to the temperature of the water in the river. The second liquid inlet and outlet may be operatively connected to a cooling tower, while the first liquid outlet may be connected to a paper pulp washing station.

12 Claims, 9 Drawing Figures

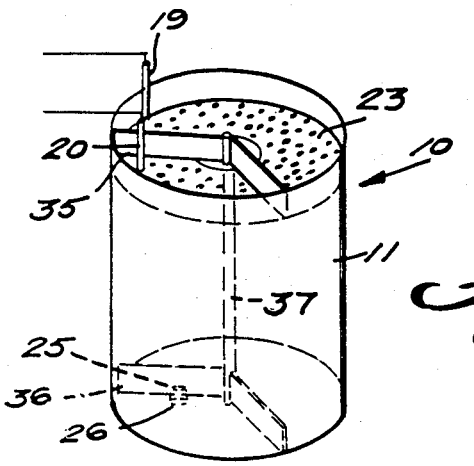
Fig. 1
Fig. 2
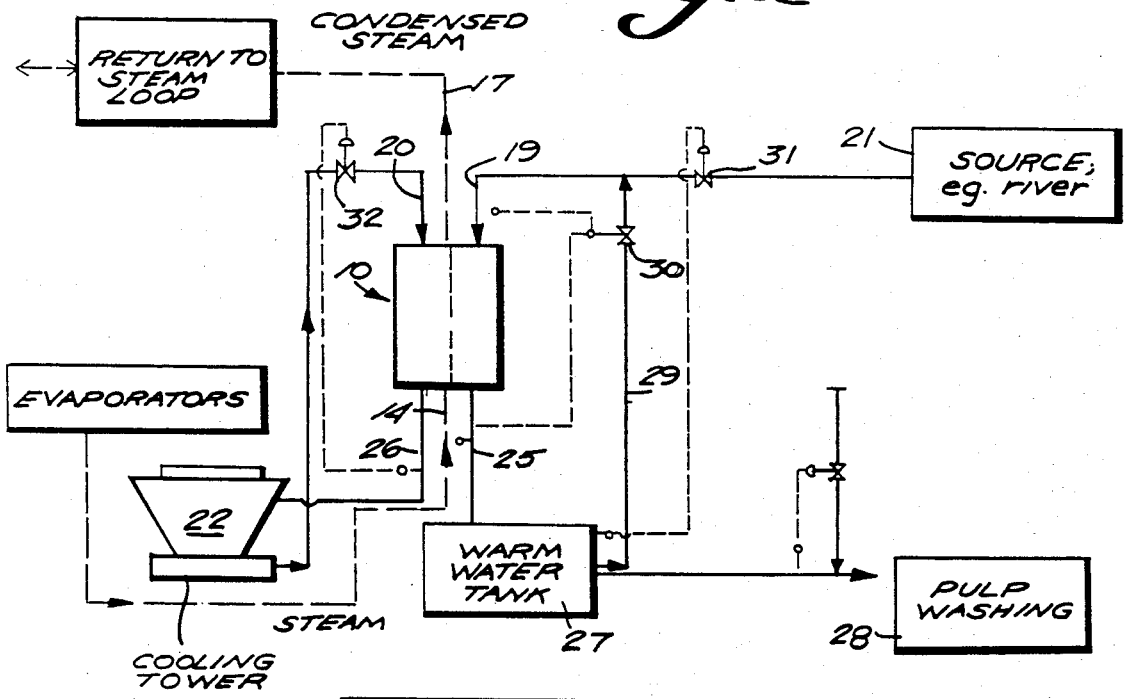
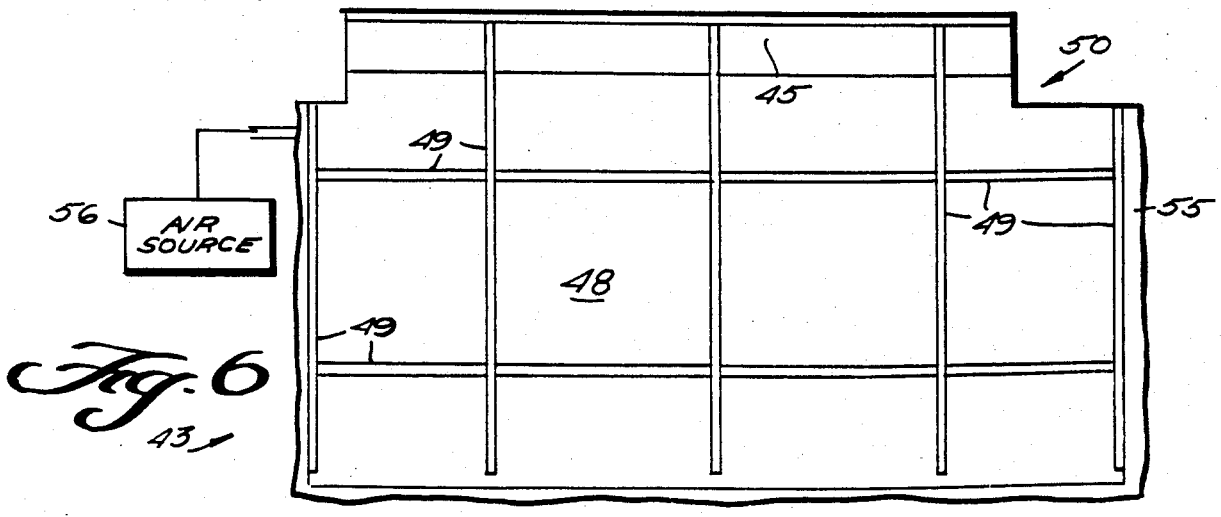
Fig. 6

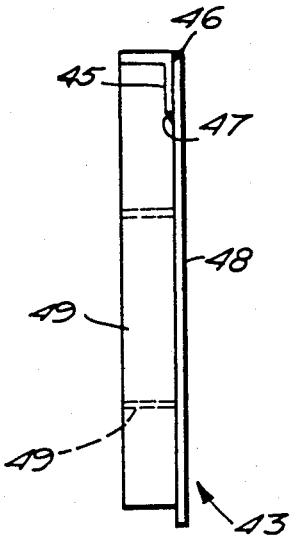
Fig. 7
Fig. 8
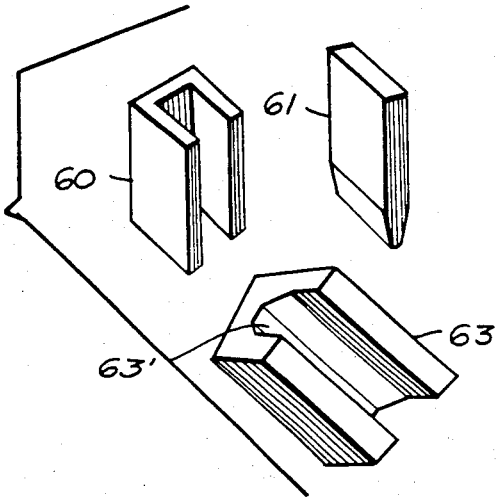
Fig. 9
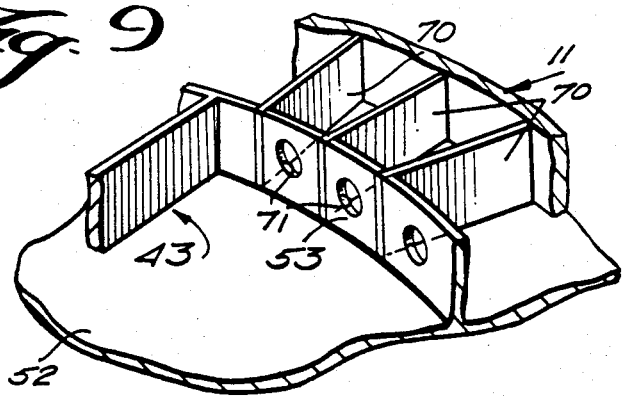

HEAT EXCHANGE TREATMENT OF FLUIDS

This is a division, of application Ser. No. 480,752, filed Mar. 31, 1983, now U.S. Pat. No. 4,519,446.

BACKGROUND AND SUMMARY OF THE INVENTION

There are many processes in which a heated fluid circulating in a closed loop must have a major portion of the heat removed therefrom. One example of such a process is steam flowing in evaporators in a pulp and paper mill. Typically, the steam from the last effect of evaporators passes to a condensing tower wherein the steam is passed between pairs of dimpled condensing plates, while a film of water flows over the exterior of the condensing plates to remove heat from the steam. The water is typically provided in a single closed loop system, and is connected to a cooling tower or the like. In such operations it is essential to provide the necessary degree of cooling of the steam to effect condensation thereof, but typically the low-grade heat given up by the steam as it condenses is wasted.

According to the present invention, a method and assembly are provided which minimize the waste of heat from the steam condensed in the condensing tower. This is accomplished by passing process inlet water from a clean water source through the condensing tower, the water being warmed up so that less heat need be added thereto to use the water in an appropriate operation within the plant. For instance it is necessary to heat the water that is used in the pulp washing steps in a pulp and paper mill, therefore passing water from a clean water source (e.g. a river) through the condensing tower to heat the water greatly facilitates the utilization of that water for subsequent pulp washing.

While it is thus highly desirable to utilize water from a clean water source as the cooling water in a condensing tower, the temperature of the water from the source varies greatly depending upon the season, and the volume of water utilized is not sufficient to provide all the necessary condensing required. Therefore, according to the present invention two flows of condensing liquid are provided in a condensing tower. The first flow is from the source of clean water, with an outflow to a pump washing station or the like, while the second flow—which is always maintained segregated from the first flow—is provided in a typical closed loop, such as a conventional loop containing a cooling tower. Apparatus is provided associated with the condensing tower for varying the amount of water flowing in the first and second flows depending upon the temperature of the clean water source.

The apparatus according to the invention includes a vertical cylindrical vessel having a plurality of pairs of condensing plates disposed therein, preferably in an annular arrangement defining a central circular-cross-section interior opening. Steam to be condensed passes between the condensing plates of each pair. First and second water inlets are provided at the top of the vessel, separated by a radially extending fixed baffle, while first and second liquid outlets are disposed at the bottom of the vessel separated by another radially extending fixed baffle. A vertical central shaft extends in the interior of the vessel with a top movable baffle and a bottom movable baffle mounted thereto. The shaft is rotated to vary the positions of the top and bottom movable baffles with respect to the first and second water inlets and outlets to thereby vary the number of condensing plates associated with the first and second liquid flows.

It is the primary object of the present invention to provide an effective method and apparatus for the simultaneous heating of process inlet water from a clean water source, and removal of heat from a heated fluid (such as steam) passing in a closed circulatory loop. This and other objects of the invention will become clear from an inspection of the detailed description of the invention, and from the appended claims.

BRIEF DESCRIPTION OF THE DRAWINGS

FIG. 1 is a schematic perspective view of an exemplary vertical cylindrical vessel according to the present invention;

FIG. 2 is a schematic diagram illustrating an exemplary inter-connection of the vessel of FIG. 1 in various treatment and treating fluid loops;

FIG. 6 is a side view of the movable lower baffle of the assembly of FIG. 3, and FIG. 7 is an end view of that baffle;

FIG. 8 is an exploded detail view of components of the upper movable baffle locking assembly; and FIG. 9 is a detail perspective view of the bottom liquid withdrawal of the vessel of FIG. 3.

DETAILED DESCRIPTION OF THE DRAWINGS

Figure 3:
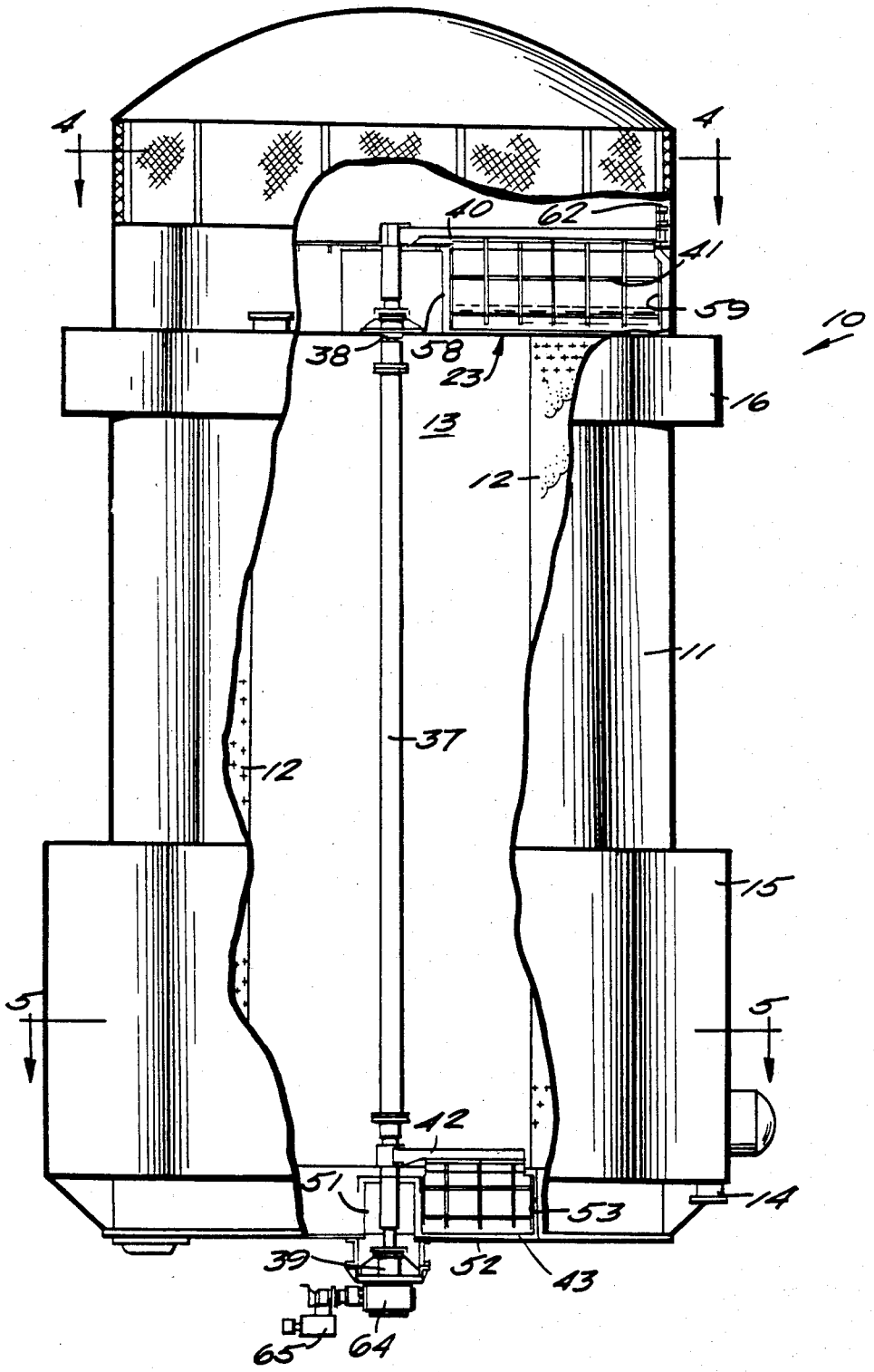
FIG. 3 is a side view, with portions cut away for clarity of illustration, showing an exemplary vertical vessel according to the present invention.

An exemplary condensing assembly according to the present invention is illustrated generally by reference numeral 10 in FIGS. 1 through 3. Assembly 10 comprises a vertical cylindrical vessel 11 having a plurality of pairs of condenser plates 12 (see FIGS. 3 and 4 in particular) disposed therein. The condenser plates 12 are preferably of the dimpled type, such as shown in U.S. Pat. No. 3,512,239 (the disclosure of which is hereby incorporated by reference herein), and are disposed vertically in a substantially annular array defining a central vertical interior passageway 13 substantially circular in cross-section. A condensable gas, such steam, is introduced through inlet 14 into vapor inlet belt 15 to flow upwardly between the plates 12 to condense, with remaining gases vented from the top vent gas belt 16 and clean condensate draining out the bottom between the plates to be returned to a closed steam loop. The condensate withdrawal conduit is not illustrated in the detailed drawings, but is shown schematically by reference numeral 17 in FIG. 2.

The condensing assembly 10 also includes a first inlet for cooling water, 19, and a second inlet 20. The inlet 19, as shown schematically in FIG. 2, is operatively connected to a source of clean water, such as a river 21. The second inlet 20 is connected to the discharge from a cooling tower 22, or another closed-loop system component. The inlets 19, 20 discharge water therefrom onto the top of an inlet plate 23 disposed in the vessel 11 above the condenser plates 12. A portion of the plate 23 above the condenser plates 12 is perforated, as seen schematically in FIGS. 1 and 4, while the area thereof over the central opening 13 is solid.

The assembly 10 further comprises a first cooling liquid outlet 25, and a second cooling liquid outlet 26, the outlet 25 operatively communicating with the inlet 19, and the outlet 26 operatively communicating with the inlet 20. In a typical environment in which the invention is utilized, the outlet 25 is operatively connected to a warm water tank 27, which in turn is connected to a station 28 at which the water warmed by the passage through the assembly 10 is utilized, such as a pulp washing station. A recirculation conduit 29, controlled by valve 30, also is preferably provided between the warm water tank 27 and the inlet 19 to circulate some water from tank 27 to the line 19 depending upon the initial temperature of the source 21 water. In the typical process illustrated in FIG. 2, the valve 31 in the inlet 19 also is throttled in response to the temperature of water in the warm water tank 27. Also, a second outlet 26 is connected to the inlet for cooling tower 22, and the second inlet 20 is throttled by valve 32 in response to the temperature of water in the second outlet 26.

In the vessel 11 there are provided top and bottom fixed baffles 35, 36. The top fixed baffle 35 is disposed between the inlets 19, 20, and the bottom fixed baffle 36 between the outlets 25, 26. In the central passageway 13 a vertical shaft 37 extends from the top to the bottom of the vessel 11, being mounted for rotation in bearing 38 connected to inlet plate 23 at the top thereof, and also being mounted for rotation in bearing 39. Mounted to the top of the shaft 37 for rotation therewith is the movable baffle supporting arm 40, supporting top movable baffle 41, and connected adjacent the bottom of the shaft 37 is the movable baffle supporting arm 42 supporting lower movable baffle 43.

The movable baffles 41, 43 have similar constructions, although differing substantially in dimensions, and a construction of the bottom movable baffle 43 is illustrated in FIGS. 6 and 7, the illustration in FIG. 7 showing the elastomeric sealing tube removed for clarity of illustration. The top of the lower movable baffle 43 is defined by angle iron 45 welded at points 46, 47 to main steel plate 48. A plurality of reinforcing gusset plates 49 are disposed at the front, rear, and intermediate horizontal and vertical portions to provide support to the plate 48. The top plate 45 is connected to the support arm 42 by bolts or the like passing through the arm 42 and openings (not shown) formed in the top portion of angle iron 45, and a cut-out 50 may be formed in the portion of movable baffle 43 most remote from the shaft 37 to accommodate overlapping portions of the condensing plates 12 (see FIG. 3).

The bottom removable baffle 43 cooperates with a pipe stand 51, the bottom 52 of the vessel 11, and an arcuate channel iron 53. Sealing means are preferably provided for sealing the peripheral portions of the baffle 43 where it cooperatively engages the stand pipe 51, bottom 52, and channel iron 53. Such sealing means— shown in FIG. 6— preferably take the form of an elastomeric tube 55 that is inflatable, cooperating with air source 56. A typical seal utilizable with the movable baffle 43 is the inflatable seal produced by Seal Master Corporation of Kent, Ohio. When the elastomeric tube 55 is inflated with air from source 56 no liquid can pass past the bottom or sides of the baffle 43.

The top movable baffle 41 is vertically aligned with the bottom baffle 43, and preferably the same type of sealing means are provided for it as for the bottom baffle 43. The sealing means cooperating with the upper movable baffle 41 provide a sealing engagement between it and the upper stand pipe 58 connected to inlet plate 23, the inlet plate 23 (particularly the perforated portion thereof), and the interior upper wall portion 59 of the vessel 11.

Means are also provided associated with the upper movable baffle 41 for locking it in a position to which it has been moved. The locking means preferably comprises a pawl guide block 60 (see FIG. 8) mounted to the radial-most termination of the upper arm 40, with a pawl 61 slideable in the block 60. A linear reciprocating means, such as an hydraulic cylinder 62 (see FIG. 3) is provided connected to the pawl 61 for vertically reciprocating it, guided by block 60. Around the interior periphery of the vessel 11, operatively engaging interior wall 59, there are provided a plurality of locking blocks 63 (see FIG. 8) each of which is positioned to receive the pawl 61 therein. The blocks 63 are adjacent each other forming an arc around the interior wall 59, and the pawl-receiving openings 63' therein are spaced from each other a spacing defining an increment of indexing of the shaft 37 (and thus movable baffles 41, 43) during its rotation.

Means are provided, such as gear box 64 and motor 65, for rotating the shaft 37 about a vertical axis defined by the bearings 38, 39. The rotating means preferably comprising a self-locking means for locking the shaft 37 in a position to which it has been moved. The rotation preferably is an indexed rotation so that the shaft 37 moves in increments, and the arcuate extent of each increment is preferably the arcuate distance between a given number of pairs of condenser plates 12 (e.g. about 2 degrees-16 degrees). Preferably the movable baffles are movable through an arc of about 150 degrees; i.e. from the solid line position illustrated in FIG. 4 to the dotted position illustrated therein. Self-locking of the shaft 37 may be provided by utilizing the gear box 64 having a gear ratio of about 38,000 to 1. With such an arrangement, it is possible to rotate the shaft 37 even when several inches of water (less than the height of the baffles 35, 41) is provided on the top of inlet plate 23 and while water is falling as a film down the condenser plates 12. Utilizing such a power source it takes a relatively long time for the shaft 37 to rotate through a small arc, but speed of rotation thereof is not important since the movable baffles will be repositioned rather infrequently (e.g. about once a month).

Figure 5:
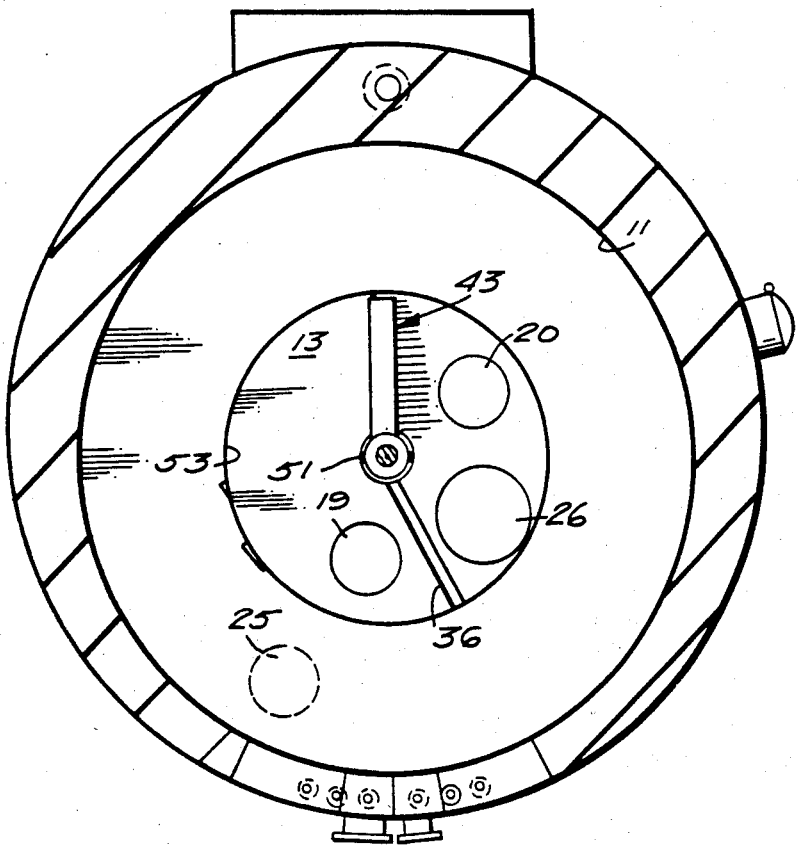
FIG. 5 is a cross-sectional view taken along lines 5—5 of FIG. 3.

In order to provide for drainage of water through the first and second outlets 25, 26 provided in the bottom 52 of vessel 11, the compartments illustrated in FIG. 9 are utilized at least over the entire 150 degree arcuate extent of travel of the bottom movable baffle 43. The radially extending compartment dividing walls 70 are provided between the exterior wall of vessel 11 and the arcuate channel iron 53, the spacing between the compartment walls 70 being comparable to the spacing between one or a plurality of condenser plates 12, and the spacing between pawl-receiving openings 63' in locking blocks 63. A radially extending opening 71 is defined in channel iron 53 between each pair of walls 70 to allow water collecting in the compartment defined by the walls 70 to pass to the top surface of the bottom 52 of the vessel 11 in the interior opening 13 thereof. The second liquid outlet 26 is provided in that area, however as shown in FIG. 5 the first outlet 25 is radially spaced from that area. However, the outlet 25 directly communicates with the open area 13, the outlet 25 being provided between a pair of bottom supports (not shown) and in free open communication with the interior area 13 between the fixed baffle 36 and the left-side (as seen in FIG. 5) of bottom movable baffle 43.

OPERATION

The operation of the invention will now be described with respect to a typical process in a pulp and paper mill. However, it is to be understood that the method and apparatus according to the invention are utilizable for the practice of other specific processes and in other specific environments, being utilizable in any environment where it is desirable to heat inlet process water and at the same time cool a circulating loop of heated fluid.

Steam from a last evaporative effect of a pulp and paper mill is fed between condensing plates 12 in the assembly 10 in a conventional manner, the steam passing upwardly between the plates and being cooled by water flowing over the exterior surfaces of the plates, and being condensed. The condensed steam is returned via line 17 to a steam loop within the pulp and paper mill, and the exhaust vapor is appropriately vented from vent gas belt 16.

Figure 4:
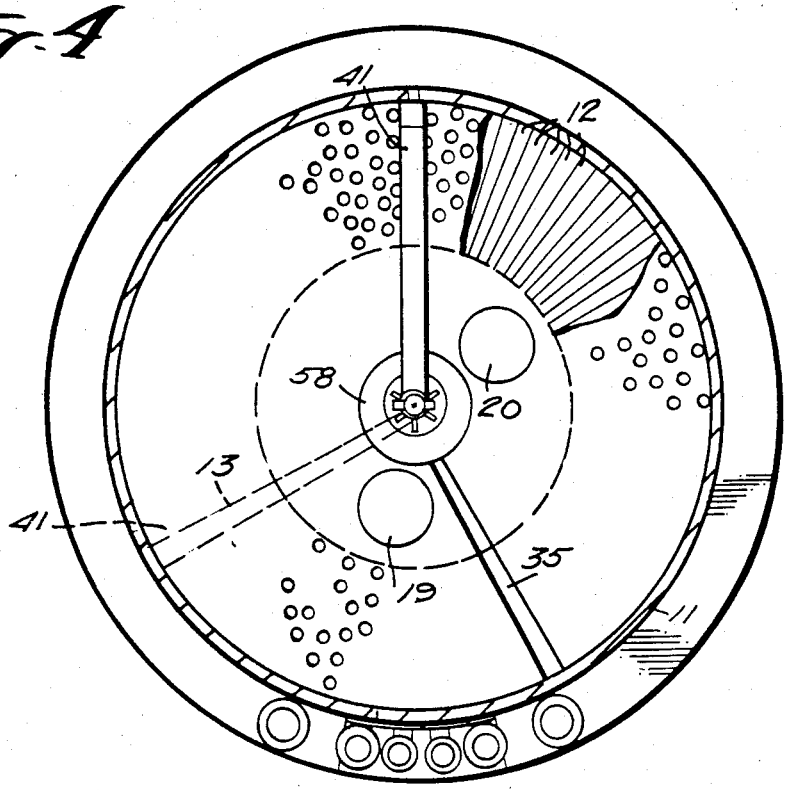
FIG. 4 is a cross-sectional view of the vessel of FIG. 3 taken along lines 4—4 thereof.

Cooling water for condensing the steam is provided from two sources. The first source is the clean water source—river 21—water flowing therefrom through first inlet 19 to the top of the plate 23 between the left-hand side of baffles 41, 43 (as seen in FIGS. 4 and 5) and the fixed baffles 35 and 36. The water flows downwardly through the perforations in the inlet plate 23 over the exterior surfaces of a plurality of the condenser plates 12, finally passing to the bottom 52 of the vessel 11 and passing through first outlet 25. First outlet 25 discharges into warm water tank 27, and the majority of the water is fed therefrom to the pulp washing station 28, the clean water—preheated by passing it through the assembly 10—being utilized in the pulp washing station 28.

The second source of cooling water is from the conventional cooling tower 22 commonly utilized for condensers in pulp and paper mills. Water exiting the cooling tower 22 flows through second inlet pipe 20 to the top of the inlet plate 23, passing through the perforations in plate 23 over the exterior surfaces of a plurality of condensing plates 12 disposed between the right-hand side of the movable baffles 41, 43 (as seen in FIGS. 4 and 5) and the fixed baffles 35, 36, and exiting the bottom of the vessel 11 through the second outlet 26. The second outlet 26 is connected to the inlet for the cooling tower 22.

Depending upon the temperature of water in the source 21, the positions of the movable baffles 41, 43 vis-a-vis the fixed baffles 31, 36 will be changed to enlarge or decrease the number of condensing plates 12 associatd with each of the inlets 19, 20. The following table illustrates exemplary positionings of the movable baffles 41, 43 for different months of the year and different river 21 temperatures for one exemplary installation, the table also indicating the heat recovery achieved utilizing the invention as compared to a conventional condenser in a pulp and paper mill.

TABLE A

Baffle Position and Heat Savings for 5000 GPM Warm Water

| Item Name | SEASONAL DATE SOURCE 21 (RIVER) TEMP. | CONTROLLED TEMPERATURES INLET 19 TEMP. | INLET 20 TEMP. |
|---|---|---|---|
| Month | (°F.) | (°F.) | (°F.) |
| Jan | 57 | 85 | 85 |
| Feb | 50 | 85 | 85 |
| Mar | 57 | 85 | 85 |
| Apr | 64 | 85 | 85 |
| May | 71 | 85 | 85 |
| Jun | 78 | 85 | 85 |
| July | 86 | 86 | 88 |
| Aug | 90 | 90 | 90 |
| Sept | 86 | 86 | 88 |
| Oct | 78 | 85 | 85 |
| Nov | 71 | 85 | 85 |
| Dec | 64 | 85 | 85 |

TABLE A-continued

Baffle Position and Heat Savings for 5000 GPM Warm Water

| | OPTION A: 5000 GPM MAXIMUM FLOW | | | |
|---|---|---|---|---|
| | WARM WATER FLOW LIMITS | | RESULTS | |
| Item Name Month | Maximum Warm Water Flow (GPM) | Minimum Warm Water Flow (GPM) | Baffles 41, 43 Position (°Angle) | Max. Flow Heat Recovery (Avg: 110) (MBTU/HR) |
| Jan | 5000 | 3700 | 188 | 145.0 |
| Feb | 5000 | 3840 | 211 | 162.5 |
| Mar | 5000 | 3700 | 188 | 145.0 |
| Apr | 5000 | 3530 | 166 | 127.5 |
| May | 5000 | 3290 | 143 | 110.0 |
| Jun | 5000 | 2970 | 120 | 92.5 |
| July | 5000 | 3160 | 96 | 72.5 |
| Aug | 5000 | 3470 | 87 | 62.5 |
| Sept | 5000 | 3160 | 96 | 72.5 |
| Oct | 5000 | 3170 | 120 | 92.5 |
| Nov | 5000 | 3290 | 143 | 110.0 |
| Dec | 5000 | 3530 | 166 | 127.5 |

The rotation of the shaft 37 to reposition the baffles 41, 43 can be manually controlled, or can be automatically controlled in response to sensing of the temperature in the river 21. In a typical manual control, every month an operator would first operate hydraulic cylinder 62 to pull pawl 61, guided by pawl guide block 60, out of operative engagement with a locking block 63, and then operate motor 65 to power gear box 64 to rotate the shaft 37 through a few degrees. When the new position was reached, the motor 65 would be stopped and the cylinder 62 actuated to move the pawl 61 downwardly into operative association with the opening 64 in another locking block 63. Movement could be accomplished even while the assembly 10 was in use to pass cooling water over the plates 12, the flow streams defined by first inlet and outlet 19, 25 and second inlet and outlet 20, 26 being segregated the entire time.

The operation of adjusting the positions of movable baffles 41, 43 would be effected every month, as indicated in Table A above, to achieve optimum preheating of water for the pulp washing station 28, while simultaneously providing enough cool water for condensing of the steam flowing between condenser plates 12. Further, in winter months, it may be desirable to recirculate a portion of the water from warm water tank 27 through line 29, and to control valves 30, 31, to insure that the water utilized in station 28 is heated a desired degree.

It will thus be seen that according to the present invention an improved assembly and method are provided for preheating clean process inlet water while at the same time removing heat from a heated fluid passing between heat-transfer plates.

While the exemplary embodiment of the invention that has been illustrated and described utilizes two inlets and outlets and one movable baffle, it is to be understood that the invention is not so limited. A plurality of inlets and outlets, and a plurality of movable baffles, may be utilized within the scope of the invention.

It will also be apparent to those of ordinary skill in the art that many other modifications may be made within the scope of the invention, which scope is to be accorded the broadest interpretation of the appended claims so as to encompass all equivalent structures and methods.

What is claimed is:

1. An assembly for treating process fluids to effect heat-exchange therebetween, comprising:

a plurality of vertically arranged pairs of heat-transfer plates disposed in pairs and are disposed in an annular arrangement around the interior of a vertical vessel;

means for passing a heated fluid between pairs of said plates to reduce the heat content of said fluid, and returning said fluid with reduced heat content to a source;

means effecting a first flow of liquid over the exterior surfaces of a plurality of said heat-transfer plates;

means for effecting a second flow of liquid over the exterior surfaces of a second plurality of said heat-transfer plates;

means for segregating said first and second flows so that liquid in said first and second flows does not intermix comprising first and second liquid inlets disposed at the top of said vessel on the opposite sides of a top fixed radially extending baffle, and first and second outlets disposed at the bottom of the said vessel on the opposite sides of a bottom radially extending fixed baffle; and means for adjusting the number of heat-transfer plates the liquid in said first flow comes in contact with, with respect to the number of heat-transfer plates the liquid in said second flow comes in contact with, comprising top and bottom movable baffles rotatable by a central shaft to vary the arcuate spacing between said movable baffle and each of said first and second liquid inlets and outlets.

2. An assembly as recited in 1 wherein said first flow is operatively connected to a source of clean water, and afer passing in contact with a plurality of heat-transfer plates passes to a paper pulp washing apparatus for use as pulp washing liquid.

3. An assembly as recited in claim 2 wherein said second flow of liquid is operatively connected to the inlet and to the outlet of a cooling tower and provides a closed loop flow.

4. An assembly as recited in claim 2 further comprising a warm water tank disposed in said first flow between said heat-transfer plates and said pulp washing station; and means for circulating a portion of the water from said warm water tank to said first liquid flow between said source of clean water and said heat-transfer plates, depending upon the temperature of water in said source of clean water.

5. An assembly as recited in claim 1 further comprising a self-locking gearing assembly for rotating said central shaft and for rotating said movable baffles through a maximum arcuate extent of approximately 150°.

6. An assembly as recited in claim 1 further comprising means for indexing said central shaft, during rotation thereof, in increments comparable to the spacing between pairs of said heat transfer plates.

7. An assembly as recited in claim 1 further comprising an inlet plate disposed above said pairs of plates and having an outer annular perforated region coincident with said annular arrangement of heat transfer plates; a central stand pipe portion formed above said inlet plate and operatively connected thereto; and sealing means formed on the periphery of said top movable baffle for sealing said top movable baffle with said central stand pipe portion, said inlet plate, and an interior wall of said vessel.

8. An assembly as recited in claim 7 wehrein said sealing means comprise an inflatable elastomeric tube mounted around the peripheral portions of said top movable baffle and are aligned with said inlet plate, central stand pipe portion, and interior vessel wall.

9. An assembly as recited in claim 1 wherein said vertical vessel comprises a cylindrical vessel having an interior wall; and wherein at the bottom of said cylindrical vessel there is provided a central stand pipe portion concentric with said central shaft; a curved channel iron portion concentric with said central shaft and radially spaced both from said central stand pipe section and said vessel interior wall, said channel iron spaced radially from said central shaft the approximate radial spacing of said condenser plates from said central shaft, and said channel iron having radially extending openings formed therein, one opening being provided between each of said pairs of vertical condensing plates; and sealing means for sealing said movable bottom baffle to the vessel bottom, said curved channel iron, and said central stand pipe portion.

10. An assembly as recited in claim 9 wherein said bottom movable baffle sealing means comprise an inflatable elastomeric tube formed around the periphery of said bottom movable baffle along with surfaces thereof cooperating with aid central stand pipe, vessel bottom, and curved channel iron.

11. An assembly as recited in claim 6 further comprising locking means for operatively locking at least one of said movable baffles in substantially any indexed position.

12. An assembly as recited in claim 11 wherein said locking means comprise a vertically reciprocal pawl formed on an end of said top movable baffle most remote from said central shaft, and guided in a pawl block mounted on said movable baffle, and vertically reciprocal by reciprocal power means mounted on said top movable baffle; and a plurality of locking blocks disposed arcuately along the interior of said vertical vessel and having pawl receiving portions thereof arcuately spaced from each other a distance corresponding to the indexing spacing.

* * * * *